US005595559A

United States Patent [19]

Viel

[11] Patent Number: 5,595,559

[45] Date of Patent: Jan. 21, 1997

[54] MUSCLE STRETCHING APPARATUS AND METHOD

[76] Inventor: Joseph E. Viel, 55 Portland St., Lawrence, Mass. 01843

[21] Appl. No.: 505,866

[22] Filed: Jul. 24, 1995

[51] Int. Cl.[6] ..... A63B 21/002

[52] U.S. Cl. ..... 482/91; 482/114; 482/904; 482/909

[58] Field of Search ..... 482/907, 91, 114, 482/904, 95

[56] References Cited

U.S. PATENT DOCUMENTS

| | | | |
|---|---|---|---|
| 2,183,265 | 12/1939 | Maloney | 482/95 |
| 3,117,782 | 1/1964 | Johnston | 482/95 |
| 3,682,276 | 8/1972 | Krauss . | |
| 3,858,874 | 1/1975 | Weider . | |
| 3,966,204 | 6/1976 | Dubach . | |
| 3,981,500 | 9/1976 | Ryan . | |
| 4,079,933 | 3/1978 | Everroad . | |
| 4,093,211 | 6/1978 | Hughes et al. . | |
| 4,114,553 | 9/1978 | Zidek . | |
| 4,251,071 | 2/1981 | Norton . | |
| 4,257,592 | 3/1981 | Jones . | |
| 4,290,171 | 9/1981 | Wilcox . | |
| 4,456,249 | 6/1984 | Calabrese . | |
| 4,685,671 | 8/1987 | Hagerman et al. . | |
| 4,730,696 | 3/1988 | Johnson . | |
| 4,733,862 | 3/1988 | Miller . | |
| 4,765,005 | 8/1988 | Hippel . | |
| 4,781,138 | 11/1988 | Hay . | |
| 5,024,433 | 6/1991 | Mosberg . | |
| 5,046,442 | 9/1991 | Hay . | |
| 5,067,709 | 11/1991 | Christianson . | |
| 5,261,865 | 11/1993 | Trainor . | |
| 5,318,494 | 6/1994 | Santighian . | |
| 5,328,433 | 7/1994 | Berman . | |
| 5,352,174 | 10/1994 | Mason et al. . | |
| 5,387,186 | 2/1995 | Edland . | |
| 5,405,306 | 4/1995 | Goldsmith et al. . | |
| 5,407,411 | 4/1995 | Trainor . | |

*Primary Examiner*—Lynne A. Reichard

*Attorney, Agent, or Firm*—Hamilton, Brook, Smith & Reynolds, P.C.

[57] ABSTRACT

A stretching apparatus for stretching muscles includes a foot coupler for coupling to a foot of a user. The foot coupler is coupled to a flexible connector which in turn is coupled to an anchoring device. The anchoring device secures the stretching apparatus to a fixed element such as a door knob. The connector includes an adjustable locking device for adjusting the length of the connector. A handle extends from the locking device for pulling the locking device downwardly and for adjusting the length of the connector.

23 Claims, 4 Drawing Sheets

MUSCLE STRETCHING APPARATUS AND METHOD

BACKGROUND

Lower back muscles are often severed during back surgery. When the severed back muscles heal, they are usually tighter than they were before surgery. The back muscles become so tight in some patients that the patients are unable to walk when they first wake up in the morning. Before walking, these patients must first reduce the tension on the lower back by either loosening their lower back muscles or muscles connected to the lower back muscles such as the leg muscles.

Loosening the leg muscles reduces the tension exerted by the leg muscles on the lower back muscles, thereby reducing lower back tension. The method commonly used for loosening the leg muscles during rehabilitation is for the patient to manually stretch the hamstring, calf and gluteus muscles with the help of his/her hands pulling on the legs and feet. The drawback of this method is that it is not only tiring for the patient but it is also difficult to properly stretch all the desired muscle groups.

The method commonly used for directly loosening the lower back muscles is to electrically stimulate the lower back muscles with an electro-stimulation device. The drawback with this method is that electro-stimulation devices are expensive, making them unavailable to some patients. In addition, electro-stimulation devices do not relieve lower back tension as effectively as stretching the hamstring, calf and gluteus muscles.

SUMMARY OF THE INVENTION

There is a need for an inexpensive apparatus for effectively reducing lower back tension in an easy and non-strenuous manner.

The present invention provides a stretching apparatus for stretching leg muscles including a foot coupler for coupling to a foot of a user. A first flexible, connecting member having a distal end is coupled to the foot coupler at that distal end. An adjustable locking device adjustably locks to the first connecting member. This allows the distance between the foot coupler and the locking device to be adjusted. A second flexible, connecting member having an anchoring end is coupled to the locking device. An anchoring device is coupled to the anchoring end of the second connecting member for anchoring the stretching apparatus to a fixed element such as a door knob. A handle extends downwardly from the locking device for pulling the locking device downwardly relative to the foot coupler and the anchoring device.

In the preferred embodiment, the first and second connecting members are lengths of rope with the foot coupler and the anchoring device being loops formed at the ends of their respective lengths of rope. The loop of rope forming the anchoring device further includes a ring which is slidably disposed about the loop for tightening the loop.

The locking device preferably comprises a tubular member of resilient material having a central bore passing therethrough. A slot along a side of the tubular member extends into the central bore. The slot includes a narrow portion and a wide portion. The central bore at one end of the locking device receives the first connecting member with a portion of the first connecting member exiting the locking device through the slot. The first connecting member is capable of being locked relative to the locking device when the first connecting member is in the narrow portion of the slot. Additionally, the first connecting member is capable of sliding relative to the locking device when in the wide portion of the slot. The portion of the first connecting member which exits the locking device forms the handle for pulling the locking device downwardly relative to the foot coupler and anchoring device as well as for moving the first connecting member from one portion of the slot into another portion of the slot.

In another preferred embodiment, the locking device includes a hole on the side of the tubular member instead of a slot. The hole extends from the side of the tubular member to the central bore. A locking member extends through the hole into the central bore for locking the first connecting member in place within the central bore. A second hole on the side of the locking device allows the first connecting member to exit the locking device.

In use, the user's hamstring muscles are stretched by coupling the user's foot to the foot coupler and elevating the foot with the leg fully extended. The calf muscles are then stretched by pulling downwardly on the handle while the foot remains elevated, thereby pivoting the foot towards the user. The gluteus muscles are stretched by pulling the user's knee into the user's chest while the foot remains coupled to the foot coupler. In order to adjust the elevation of the foot, the user either changes his/her position relative to the anchoring device or adjusts the length of the first connecting member with the locking device.

The muscle stretching apparatus of the present invention allows a user to effectively stretch hamstring, calf and gluteus muscles in an easy and non-strenuous manner making it suitable for back surgery patients. In addition, the apparatus is both inexpensive and very compact making it affordable for all patients and also suitable for travel. Furthermore, the apparatus can be used by athletes for stretching muscles before engaging in physical activities.

BRIEF DESCRIPTION OF THE DRAWINGS

The foregoing and other objects, features and advantages of the invention will be apparent from the following more particular description of preferred embodiments of the drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENTS

Figure 1:
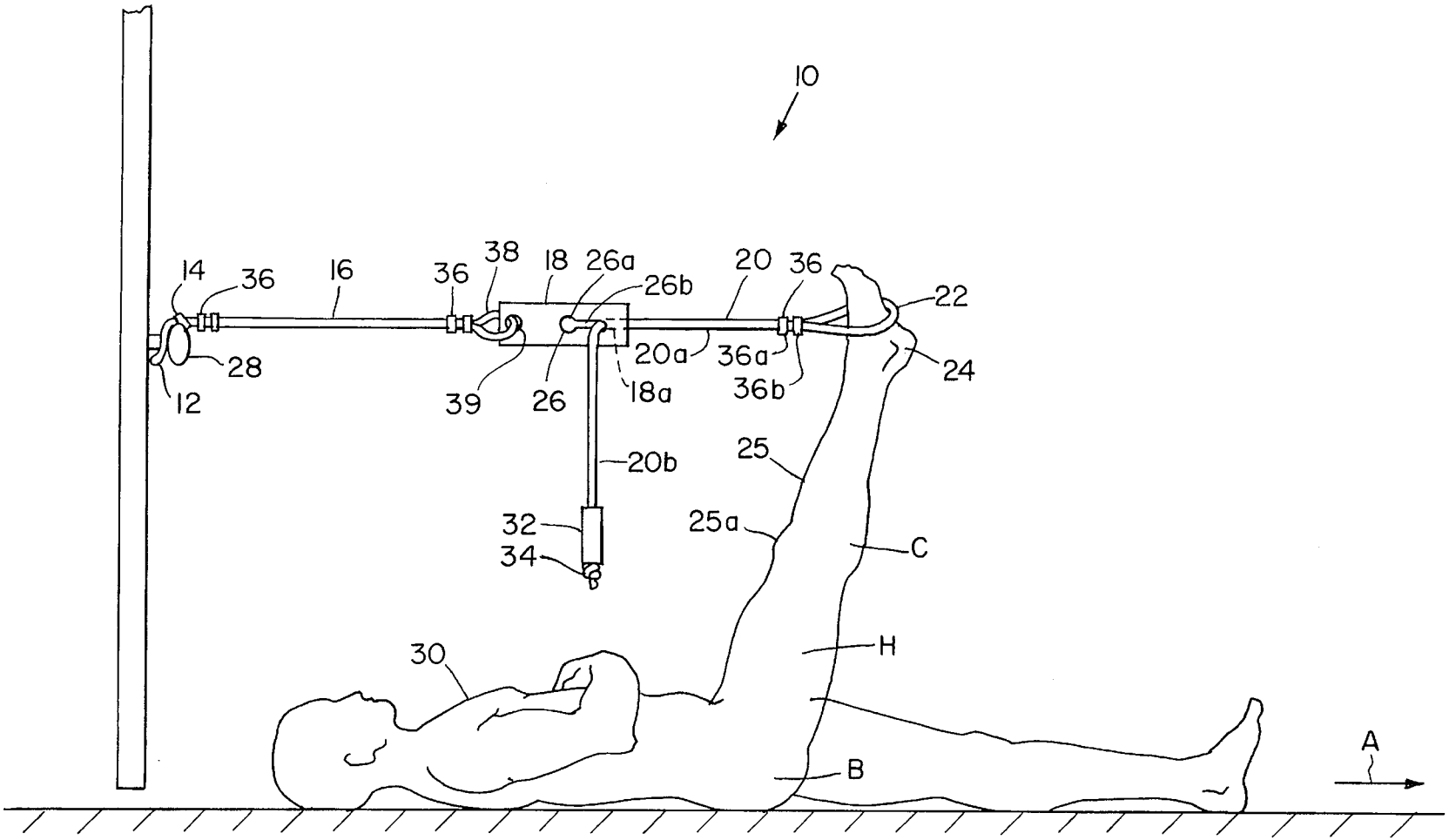
FIG. 1 is a side view of a patient employing the present invention stretching apparatus to stretch hamstring muscles.

Referring to FIG. 1, stretching apparatus 10 includes two lengths of rope coupled to an adjustable locking device 18.

One length of rope forms a first connecting member 20 which is adjustably coupled to locking device 18 through a central bore 18*a* and a slot 26. Connecting member 20 includes a loop 22 for coupling to a foot 24 of a user 30. Loop 22 is formed on the distal end of connecting member 20. The other length of rope forms a second connecting member 16 which is coupled to locking device 18. Connecting member 16 includes a loop 38 for coupling connecting member 16 to locking device 18 through hole 39. Connecting member 16 also includes a loop 12 for anchoring the stretching apparatus 10 to a fixed element such as a door knob 28. Loop 12 is formed on the end of connecting member 16 that is away from the locking device 18. Loop 12 includes a ring 14 slidably disposed about loop 12 for tightening loop 12. Locking device 18 allows the length of stretching apparatus 10 to be adjusted by adjusting the distance between loop 22 and locking device 18. As illustrated in the figures, locking device 18 is capable of being continuously lockable. Locking device 18 is shown rotated 90° from its actual position during use so that slot 26 can be seen. A portion of connecting member 20 extends from slot 26 at a right angle to the longitudinal axis of locking device 18 to form a handle 20*b* for pulling downwardly as well as for adjusting connecting member 20 within slot 26. The end of handle 20*b* preferably includes a knot 34 and a handle member 32.

In operation, stretching apparatus 10 is anchored to an elevated stationary object such as a door knob 28 by tightening loop 12 about door knob 28 with sliding ring 14. The user 30 then lies on his/her back on the floor facing away from door knob 28 and places his/her foot 24 within loop 22. Loop 22 is positioned between the heel and the ball of foot 24. The user 30 then straightens his/her leg 25. This elevates leg 25/foot 24 and stretches hamstring muscles H. The hamstring muscles include the biceps femoris, semitendinosus, adductor magnus and semimembranosus muscles.

In order to increase the elevation of foot 24 to further stretch the hamstring muscles H, user 30 can move his/her body in the direction of arrow A away from loop 12 (toward loop 22). User 30 can also increase the elevation of foot 24 by shortening the length of stretching apparatus 10. This is accomplished by decreasing the distance between loop 22 and locking device 18. User 30 first pulls connecting member 20 from slot portion 26*b* into slot portion 26*a* by pulling on handle 20*b* in the direction of slot portion 26*a*. Once connecting member 20 is in slot portion 26*a*, connecting member 20 can slide through locking device 18 by further pulling on handle 20*b*. This brings loop 22 closer to locking device 18, thereby shortening rope portion 20*a*. Handle 20*b* is then pulled in the direction of slot portion 26*b* forcing connecting member 20 back into slot portion 26*b* to lock connecting member 20 relative to locking device 18. If the user 30 wishes to decrease the elevation of foot 24, user 30 can either move his/her body in the direction of door knob 28 or increase the distance between loop 22 and locking device 18 by adjusting connecting member 20 relative to locking device 18.

Figure 2:
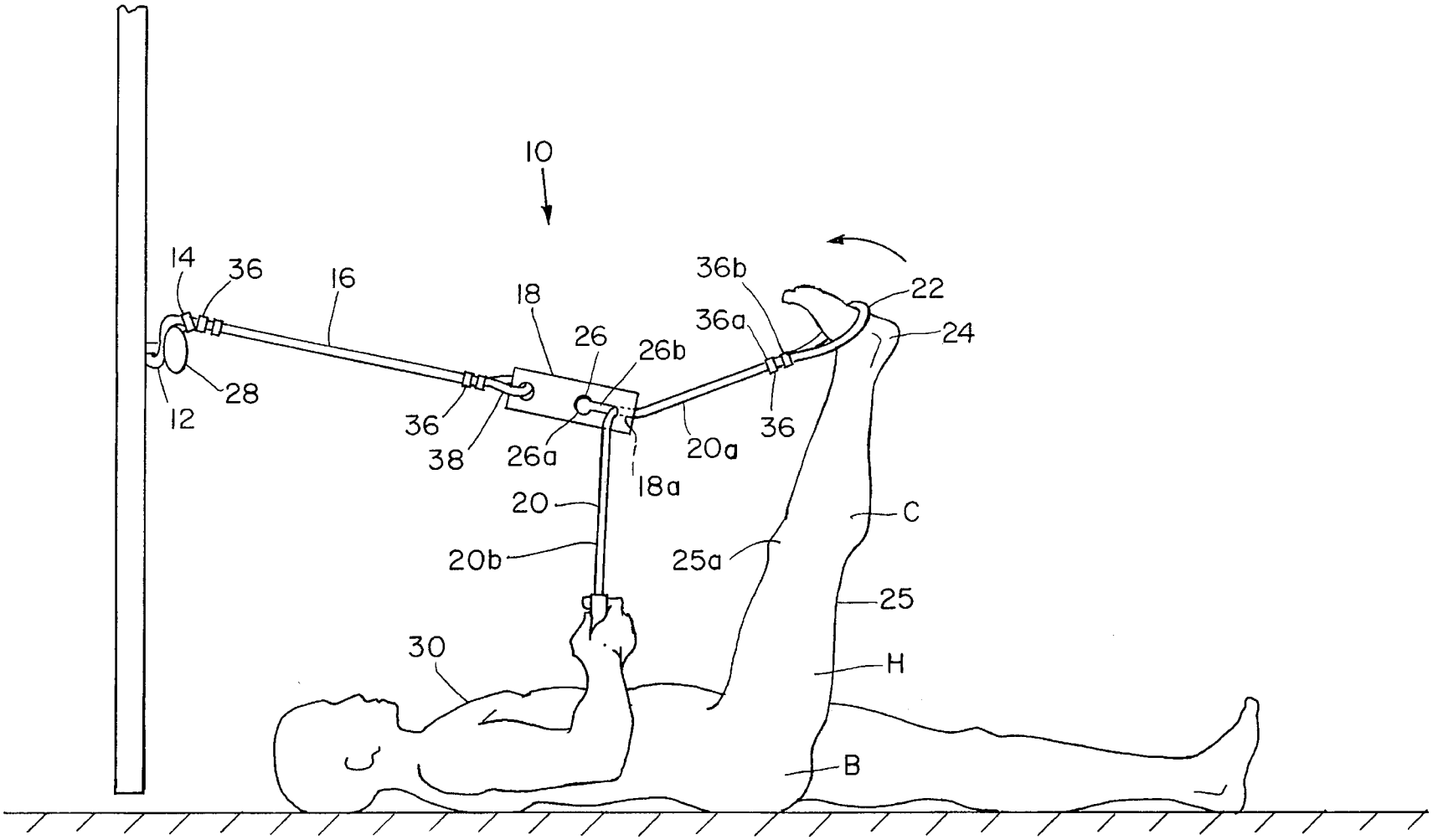
FIG. 2 is a side view of the patient employing the present invention apparatus to stretch calf muscles.

After hamstring muscles H are stretched, user 30 then grasps handle 20*b* pulling downwardly as depicted in FIG. 2. By pulling handle 20*b* downward, rope portion 20*a* is angled downwardly toward the user 30. This pivots foot 24 about the ankle pulling foot 24 towards user 30 while leg 25 remains extended and elevated, thereby stretching calf muscles C. The calf muscles include the gastrocnemius muscle.

Figure 3:
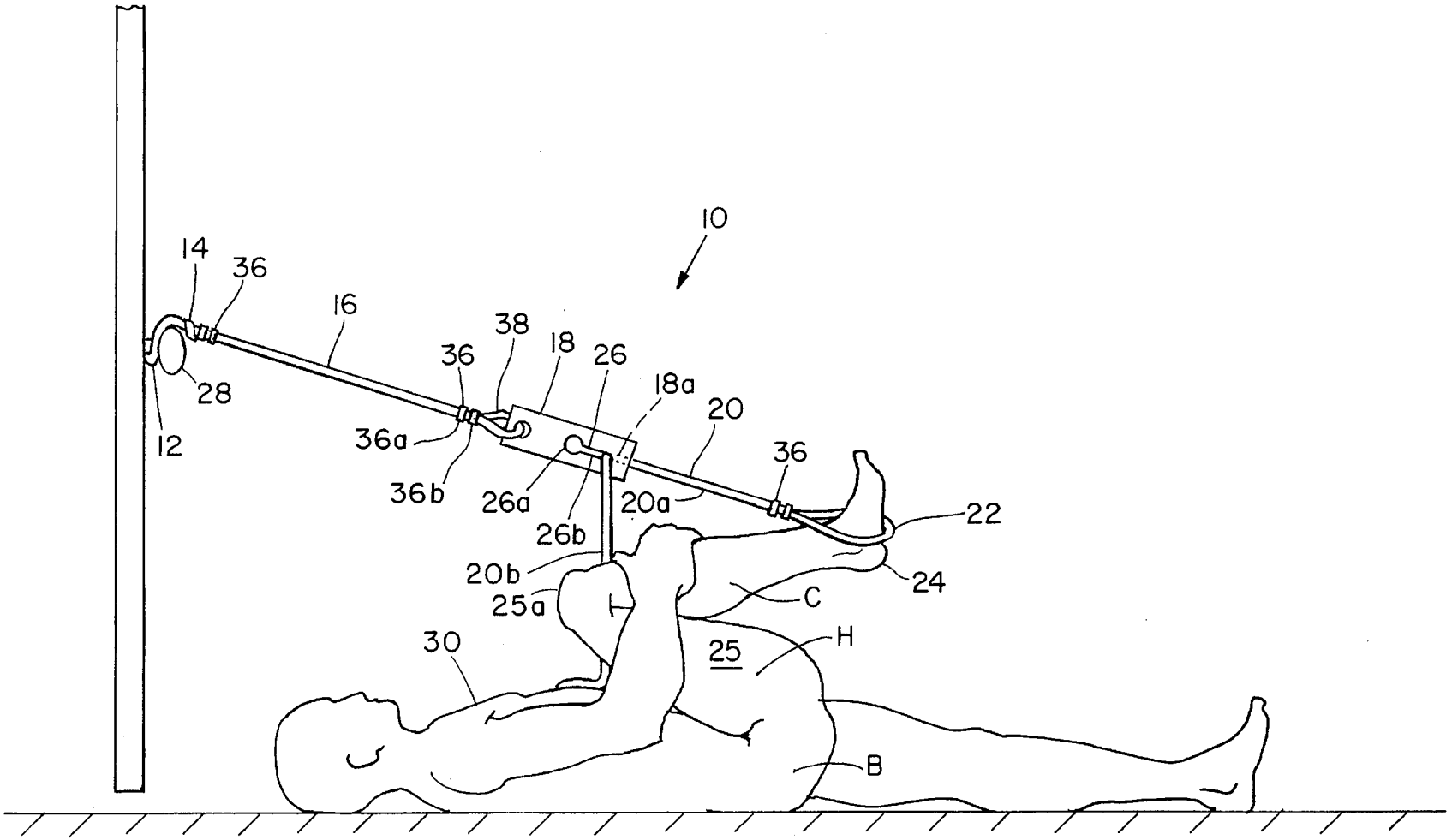
FIG. 3 is a side view of the patient employing the present invention apparatus to stretch gluteus muscles.

Once the calf muscles C are stretched, the gluteus muscles B can be stretched. User 30 grasps knee 25*a* with his/her arms to bend the knee 25*a* and then pulls the knee 25*a* into his/her chest while at the same time pulling the ankle to the side. This is accomplished while foot 24 remains within loop 22 as depicted in FIG. 3. In order to effectively stretch the gluteus muscles B, foot 24 should be raised to a height such that leg 25 makes at least an 80° angle relative to the floor. The term gluteus muscles refers to any of the muscles on the buttock including the gluteus maximus muscle. After the gluteus muscles B are stretched on leg 25, foot 24 is removed from loop 22 and the foot of the other leg is placed into loop 22. The steps described above are then repeated to stretch the hamstring, calf and gluteus muscle groups associated with the other leg. At anytime during or between each stretching exercise, the position of the user 30 or the length of stretching apparatus 10 can be adjusted.

Connecting member 16/loop 12/loop 38 and connecting member 20/loop 22 are preferably made of braided nylon rope which is ⅜ inch in diameter. The combined length of connecting member 20 and loop 22 is preferably between about 3 and 4 feet long. In addition, the combined length of connecting member 16, loop 12 and loop 38 is preferably between about 2½ and 5 feet long. Alternatively, the diameter, length, material and type of rope employed can vary. Additionally, the rope can be substituted with other flexible materials such as chain, wire, fabric webbing, strapping and flexible tubing. Stretchable materials may be employed but substantially non-stretchable flexible materials are preferred.

Loops 12, 22 and 38 are secured by binding members 36. Binding members 36 preferably include two metallic rings or bands 36*a* and 36*b* which clamp the loops closed. Alternatively, loops 12, 22 and 38 can be secured with other suitable means such as tape, thread, stitching, etc. Additionally, loops 12, 13 and 38 do not have to be integral with the connecting members 16 and 20 but can be separate entities which are secured thereto. Furthermore, the loops can be made of other suitable materials, for example, loops 12 and 22 can be adjustable lengths of hook and loop fastener or molded pieces of plastic or rubber.

The length of handle 20*b* varies depending upon the location along connecting member 20 that locking device 18 is secured. Handle member 32 is slidably attached to handle 20*b* and is preferably made of rubber. Handle member 32 is preferably about 2½ inches long, 1 inch in diameter, with a ½ inch bore. Alternatively, handle member 32 can be made of other suitable materials such as plastic and wood. Additionally, handle member 32 can be retained on handle 20*b* with a metal band or ring that is crimped on the end of handle 20*b*. When a crimped metal band or ring is employed, knot 34 is not needed. Furthermore, if desired, handle member 32 can even be omitted.

Figure 4:
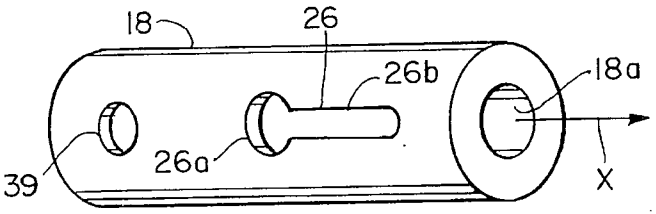
FIG. 4 is a perspective view of the adjustable locking device.

Referring to FIG. 4, locking device 18 is preferably a tubular member of rigid but resilient material with a central bore 18*a* passing longitudinally therethrough along a longitudinal axis X. Slot 26 extends along the side of locking device 18 parallel to the longitudinal axis X. Slot 26 extends through the wall of locking device 18 into bore 18*a*. Slot portion 26*a* is sized larger than the diameter of connecting member 20 in order to enable connecting member 20 to slide through locking device 18 when connecting member 20 is pulled into slot portion 26*a*. On the other hand, slot portion 26*b* is sized smaller than the diameter of connecting member 20 so that slot portion 26*b* will grip connecting member 20 to lock connecting member 20 relative to locking device 18. For example, to accommodate a ⅜ diameter rope, slot portion 26*a* is a ½ diameter hole and slot portion 26*b* is a 7/32×⅝ long slot. The resilient material allows slot portion 26*b* to expand when connecting member 20 is pulled into slot portion 26*b*. In addition, connecting member 20 is compressed by the sides of slot portion 26*b*. As a result, locking device 18 is a self-locking mechanism which locks connecting member 20 in place within slot portion 26*b* without the aid of any external measures. Although slot portion 26*b* is shown to be smooth, alternatively, slot portion 26*b* can have ridges to aggressively grip connecting member 20. Also, connecting member 16 can be adjustably coupled to locking device 18 instead of connecting member 20 by reversing the orientation of locking device 18. Furthermore, slot 26 can have two narrow slot portions so that both connecting members 16 and 20 are adjustable.

Typically, locking device 18 is about 3 inches long and 1 inch in diameter with bore 18*a* preferably being ½ inch in diameter in order to accommodate a ⅜ inch diameter rope. Hole 39 is preferably ½ inch in diameter and passes laterally through locking device 18 to provide an attachment point for coupling locking device 18 to connecting member 16 via loop 38. Alternatively, locking device 18 can be coupled to connecting member 16 by other suitable means such as hooks or eyelets. In the preferred embodiment, the locking device 18 is formed from a resilient plastic such as polypropylene or polystyrene. However, alternatively, other plastics or other resilient materials such as aluminum or other metals can be used.

Figure 5:
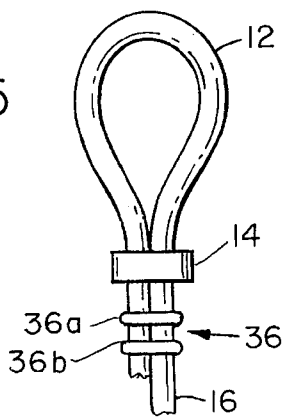
FIG. 5 is a side view of the anchoring loop.

Referring to FIG. 5, loop 12 is preferably formed by securing the end of connecting member 16 onto itself with binding member 36. Sliding ring 14 is slidably disposed about loop 12 for tightening the loop 12. Sliding ring 14 is about ½ inch wide with an inner diameter of about ¾ of an inch. In the preferred embodiment, loop 12 is tightened about an elevated object such as door knob 28. Alternatively, loop 12 can also be anchored to an object along the ground. However, this is less preferable. Additionally, sliding ring 14 is preferably plastic but can be made of other suitable semi-rigid or rigid materials such as metal.

Figure 6:
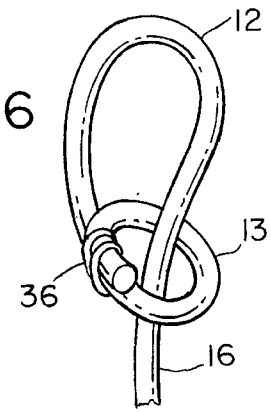
FIG. 6 is a side view of another preferred anchoring loop.

An alternative method of forming loop 12 is depicted in FIG. 6 in which sliding ring 14 is omitted. Connecting member 16 is bound to itself by binding member 36 to form a small loop 13 through which connecting member 16 passes to form loop 12. In this case, as connecting member 16 is pulled, loop 12 closes, thereby tightening loop 12 onto a desired object to anchor stretching apparatus 10. Such a loop can also be used for coupling stretching apparatus 10 to foot 24.

Figure 7:
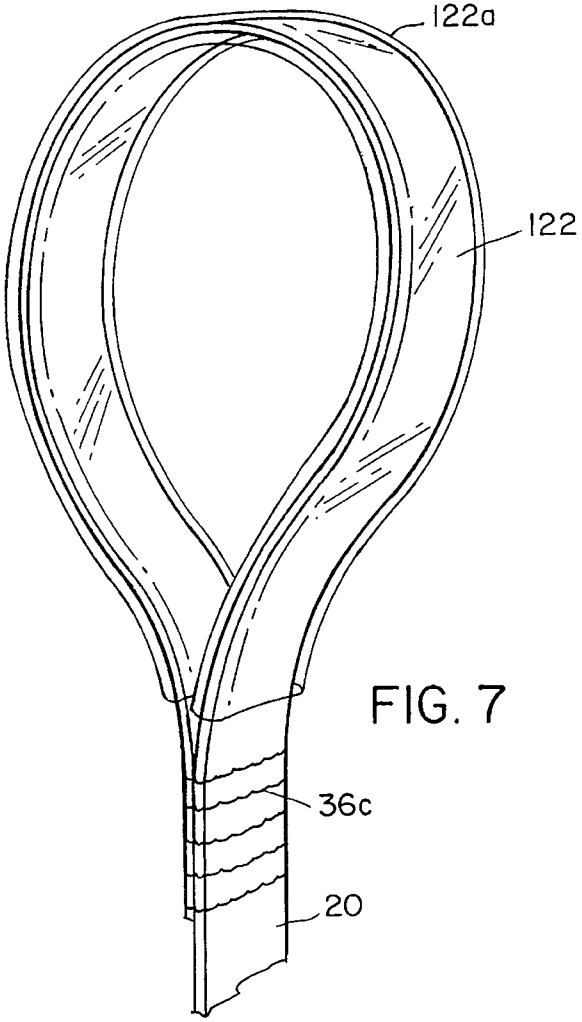
FIG. 7 is a perspective view of a preferred foot coupling loop.

Referring to FIG. 7, an alternative foot coupler is formed from a web of fabric which is sewn into a loop 122. The web is preferably one-half inch wide nylon web and is secured by stitching 36*c*. In such a case, connecting members 16 and 20 can also be nylon webbing. A plastic sheath 122*a* covers loop 122 to maintain loop 122 in a semi-rigid loop. Plastic sheath is preferably latex or polytetrafluoroethylene (PTFE) but alternatively can be any other suitable plastic such as polypropylene or nylon. Such a plastic sheath 122*a* can also be used on loop 22.

Figure 8:
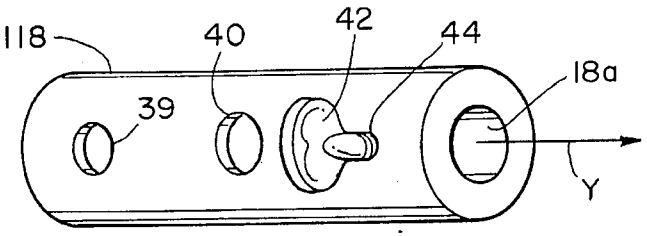
FIG. 8 is a perspective view of another preferred adjustable locking device.

FIG. 8 depicts another preferred locking device 118. Locking device 118 differs from locking device 18 in that a hole 40 and thumbscrew 42 are substituted for slot 26. Thumbscrew 42 is mounted within a threaded hole 44 for locking connecting member 20 relative to locking device 118. Thumbscrew 42 locks connecting member 20 in place by pinching connecting member 20 against the side of central bore 18*a* when tightened. Hole 40 allows connecting member 20 to exit locking device 118 at a right angle relative to longitudinal axis Y. In order to adjust connecting member 20 relative to locking device 118, thumbscrew 42 is loosened to allow movement of connecting member 20. Once connecting member 20 is moved to the desired position relative to locking device 118, thumbscrew 42 is tightened. Alternatively, thumbscrew 42 can be replaced with a spring loaded pin that can be retracted to adjust connecting member 20 relative to locking device 118 or released to lock connecting member 118 in place.

Equivalents

While this invention has been particularly shown and described with references to preferred embodiments thereof, it will be understood by those skilled in the art that various changes in form and details may be made therein without departing from the spirit and scope of the invention as defined by the appended claims. For example, locking device 18 can be replaced with other suitable adjustable locking devices including those having pulleys, cleats or clamping members. Additionally, loop 12 can be replaced with other suitable anchoring devices such as a clamping device. Furthermore, the dimensions or materials of all the components of the present invention can be altered to accommodate specific uses or needs.

What is claimed is:

1. A stretching apparatus comprising:

a foot coupler for coupling to a foot of a user;

a first flexible connecting member having a distal end, the distal end of the first connecting member being coupled to the foot coupler;

an adjustable locking device for adjustably locking to the first connecting member, the distance between the foot coupler and the locking device being adjustable, the locking device capable of being continuously lockable;

a second flexible connecting member coupled to the locking device, the second connecting member having an anchoring end;

an anchoring device coupled to the anchoring end of the second connecting member for anchoring the stretching apparatus to a fixed element; and a handle extending downwardly from the locking device for pulling the locking device downwardly relative to the foot coupler and the anchoring device.

2. The apparatus of claim 1 in which the first and second connecting members comprise lengths of rope.

3. The apparatus of claim 1 in which the foot coupler comprises a loop of rope.

4. The apparatus of claim 1 in which the anchoring device comprises a loop of rope.

5. The apparatus of claim 4 in which the anchoring device further comprises a ring slidably disposed about the loop of rope for tightening the loop.

6. The apparatus of claim 1 in which the locking device comprises a tubular member of resilient material with a central bore passing therethrough and a slot along a side of the tubular member extending from said side to the central bore, the slot comprising a narrow portion and a wide portion, the central bore at one end of the locking device for receiving the first connecting member with a portion of the first connecting member exiting the locking device through the slot, wherein the first connecting member is capable of being locked relative to the locking device when the first connecting member is in the narrow portion of the slot and is capable of sliding relative to the locking device when in the wide portion.

7. The apparatus of claim 6 in which the portion of the first connecting member exiting the locking device through the slot forms the handle.

8. A stretching apparatus comprising:

a foot coupler for coupling to a foot of a user;

a flexible connector coupled to the foot coupler, the connector including an adjustable locking device for adjusting the length of the connector, the locking device capable of being continuously lockable;

an anchoring device coupled to the connector for securing the stretching apparatus to a fixed element; and a flexible handle coupled to the connector between the foot coupler and the anchoring device for pulling the connector downwardly relative to the foot coupler and the anchoring device.

9. The apparatus of claim 8 in which the connector further comprises:

a first flexible connecting member having a distal end, the distal end of the first connecting member being coupled to the foot coupler the adjustable locking device being adjustably locked to the first connecting member, the distance between the foot coupler and the locking device being adjustable; and a second flexible connecting member coupled to the locking device, the second connecting member having an anchoring end coupled to the anchoring device.

10. The apparatus of claim 9 in which the locking device comprises a tubular member of resilient material with a central bore passing therethrough and a slot along a side of the tubular member extending from said side to the central bore, the slot comprising a narrow portion and a wide portion, the central bore at one end of the locking device for receiving the first connecting member with a portion of the first connecting member exiting the locking device through the slot, wherein the first connecting member is capable of being locked relative to the locking device when the first connecting member is in the narrow portion of the slot and is capable of sliding relative to the locking device when in the wide portion.

11. The apparatus of claim 10 in which the portion of the first connecting member exiting the locking device through the slot forms the handle.

12. The apparatus of claim 9 in which the first and second connecting members comprise lengths of rope.

13. The apparatus of claim 8 in which the foot coupler comprises a loop of rope.

14. The apparatus of claim 8 in which the anchoring device comprises a loop of rope.

15. The apparatus of claim 14 in which the anchoring device further comprises a ring slidably disposed about the loop of rope for tightening the loop.

16. The apparatus of claim 9 in which the locking device comprises:

a tubular member of resilient material with a central bore passing therethrough, the central bore for receiving the first connecting member, a hole on a side of the tubular member extending from said side to the central bore; and a locking member extending through said hole into the central bore for locking the first connecting member in place.

17. A method of stretching muscles with a stretching apparatus which comprises a foot coupler for coupling to a foot of a user, a flexible connector coupled to the foot coupler, an anchoring device coupled to the connector for securing the stretching apparatus to a fixed element and a flexible handle coupled to the connector between the foot coupler and the anchoring device, the method comprising the steps of:

coupling the user's foot to the foot coupler and elevating the foot while the foot is coupled to the foot coupler; and stretching calf muscles by pulling downwardly on the handle while the foot remains elevated, thereby pivoting the foot towards the head of the user.

18. The method of claim 17 in which elevating the foot stretches hamstring muscles.

19. The method of claim 17 further comprising the step of stretching gluteus muscles by pulling the user's knee into the user's chest while the foot remains coupled to the foot coupler.

20. The method of claim 17 further comprising the step of anchoring the stretching apparatus to a fixed element with the anchoring device.

21. The method of claim 17 further comprising the step of adjusting the elevation of the foot by changing the position of the user relative to the anchoring device.

22. The method of claim 17 further comprising the step of adjusting the elevation of the foot by changing the length of the connector.

23. A method of stretching muscles with a stretching apparatus which comprises a foot coupler for coupling to a foot of a user, a flexible connector coupled to the foot coupler, an anchoring device coupled to the connector for securing the stretching apparatus to a fixed element and adjustable locking device for adjusting the length of the a flexible handle coupled to the connector between the foot coupler and the anchoring device, the method comprising the steps of:

stretching hamstring muscles by coupling the user's foot to the foot coupler and elevating the user's foot while the foot is coupled to the foot coupler; and stretching calf muscles by pulling downwardly on the handle while the foot remains elevated, thereby pivoting the foot towards the head of the user.

* * * * *

UNITED STATES PATENT AND TRADEMARK OFFICE

CERTIFICATE OF CORRECTION

PATENT NO. : 5,595,559

DATED : January 21, 1997

INVENTOR(S) : Joseph E. Viel

It is certified that error appears in the above-indentified patent and that said Letters Patent is hereby corrected as shown below:

Col. 7, line 21, after "coupler", insert ---,---.

Col. 8, line 44, delete "adjustable locking device for adjusting the length of the".

Signed and Sealed this

Sixth Day of May, 1997

Bruce Lehman

*Attest:*

BRUCE LEHMAN

*Attesting Officer*

*Commissioner of Patents and Trademarks*